US005857674A

United States Patent [19]

Legrand

[11] Patent Number: 5,857,674

[45] Date of Patent: Jan. 12, 1999

[54] INTERACTIVE GAME

[76] Inventor: Christian Legrand, 100/203 M. Chollada, Ampur Bangbuathong, 11.110, Nonthaburi, Thailand

[21] Appl. No.: 792,605

[22] Filed: Jan. 31, 1997

[51] Int. Cl.[6] ..... A63F 9/08

[52] U.S. Cl. ..... 273/155; 273/153 S; 273/280; 273/447

[58] Field of Search ..... 273/153 R, 155, 273/153 S, 157 R, 280, 287, 276, 440, 447

[56] References Cited

U.S. PATENT DOCUMENTS

| | | | |
|---|---|---|---|
| 227,069 | 4/1880 | Stein | 273/280 |
| 959,754 | 5/1910 | Kennedy | 273/157 R |
| 1,265,497 | 5/1918 | Parker | 273/282.1 |
| 1,343,838 | 6/1920 | Niewaleski | 273/281 |
| 1,637,922 | 8/1927 | Sullivan | 273/282.1 |
| 1,656,943 | 1/1928 | Firestone | 273/280 |
| 1,976,664 | 10/1934 | Gantt | 273/157 R |
| 2,353,037 | 7/1944 | Irwin | 273/157 R |
| 2,416,959 | 3/1947 | Segal | 273/153 R |
| 2,460,264 | 1/1949 | Prentice et al. | 273/280 |
| 2,690,912 | 10/1954 | Noble | 273/157 R |
| 2,693,362 | 11/1954 | Ford | 273/157 R |
| 3,191,937 | 6/1965 | Kropinski | 273/157 R |
| 3,194,560 | 7/1965 | White | 273/282.1 |
| 3,195,896 | 7/1965 | Markham | 273/280 |
| 3,417,996 | 12/1968 | Janiszewski | 273/157 R |
| 3,422,563 | 1/1969 | Kiley | 273/157 R |
| 3,601,404 | 8/1971 | Weisbecker | 273/155 |
| 3,612,527 | 10/1971 | Rogerson | 273/282.1 |
| 3,650,534 | 3/1972 | Collett | 273/282.1 |
| 3,685,831 | 8/1972 | Walss | 273/280 |
| 3,729,198 | 4/1973 | Shaffer | 273/287 |
| 3,762,714 | 10/1973 | Wilson | 273/280 |
| 3,817,531 | 6/1974 | King et al. | 273/157 R |
| 3,865,380 | 2/1975 | Thomas | 273/280 |
| 3,963,243 | 6/1976 | Contento | 273/276 |
| 4,133,538 | 1/1979 | Ambrose | 273/157 R |
| 4,147,358 | 4/1979 | Erickson | 273/283 |
| 4,150,828 | 4/1979 | Marchese | 273/287 |
| 4,150,829 | 4/1979 | Cates | 273/282.1 |
| 4,198,055 | 4/1980 | Imatt | 273/282.1 |
| 4,373,281 | 2/1983 | Sebastian | 273/153 S |
| 4,394,017 | 7/1983 | Maloy | 273/287 |
| 4,452,455 | 6/1984 | Bergstrom et al. | 273/155 |
| 4,487,417 | 12/1984 | Engel | 273/153 S |
| 4,570,936 | 2/1986 | Meiser et al. | 273/157 R |
| 4,591,161 | 5/1986 | Vanderhoof | 273/280 |
| 4,776,802 | 10/1988 | Rind et al. | 273/157 R |
| 5,087,043 | 2/1992 | Billings et al. | 273/157 R |
| 5,201,524 | 4/1993 | Csanady et al. | 273/287 |
| 5,403,005 | 4/1995 | Avila-Valdez | 273/157 R |
| 5,405,148 | 4/1995 | Cianci | 273/282.1 |
| 5,553,854 | 9/1996 | Rum | 273/275 |
| 5,605,330 | 2/1997 | Huang et al. | 273/287 |

*Primary Examiner*—Steven B. Wong
*Attorney, Agent, or Firm*—Seidel, Gonda, Lavorgna & Monaco, PC

[57] ABSTRACT

An interactive game is contemplated having an outer container and a tray engaged within the outer container. The tray including a plurality of compartments adapted to receive and retain articles within. Openings are formed in the outer container aligned with at least a portion of each compartment. A cover is provided for selectively covering the openings and concealing the interior of the compartments. Channels are formed in the tray which extend between the sidewalls of the tray and the interior of the compartments. A book may be provided for the purposes of providing instruction or to further support the overall theme of the game.

19 Claims, 5 Drawing Sheets

INTERACTIVE GAME

FIELD OF THE INVENTION

The present invention relates to an interactive treasure finding game. In particular, the present invention relates to an interactive game having a tray with hidden compartments formed therein for holding treasure or puzzle pieces. The tray is disposed in an outer container having openings aligned with the compartments for retrieving the treasure or puzzle pieces therethrough. A book may be provided for the purposes of providing instruction or to further support the overall theme of the game.

BACKGROUND OF THE INVENTION

During recent years there has been a trend toward producing toys or puzzles for use by children which assist in educating the children as well as amusing them. Treasure finding games have always been of utmost interest to young children. Treasure finding games combine the thrill of discovery with the reward of locating hidden treasure. Treasure finding games typically require that the child use deductive reasoning skills to follow sequential directions and utilize uncovered clues to locate the hidden treasure. Preferably, treasure finding games also force the child to utilize manual dexterity to manipulate the game in order to locate the hidden treasure.

SUMMARY OF THE INVENTION

The present invention relates to an interactive game having hidden or secret compartments in which various articles may be stored. The interactive game includes an outer container and a tray engaged within the outer container. The tray includes a plurality of compartments adapted to receive and retain articles therein. Openings are formed in the outer container aligned with at least a portion of each compartment. A cover is provided for selectively covering the openings and concealing the compartments. Channels are formed in the tray which extend between the sidewalls of the tray and the interior of the compartments.

A stick or similar probe may be provided which is adapted to be inserted into the channels for manipulating the articles within the compartments. An elongated chamber may be formed in the tray adapted to receive and hold the stick when not in use. I elongated chamber is contemplated to be accessible through one of the compartments.

A removable panel may be located in one of the compartments for partitioning the compartment into a first and second portion; the first portion being in communication its associated opening and the second portion being inaccessible to the associated opening until the panel is removed.

In one form of the inventions, the cover may comprises an inner disc and an outer disc with the inner disc having a cut-out portion and the outer disc having an opening. The discs are rotatably attached to the outer container. The discs are dimensioned to cover the openings and adapted to selectively uncover the openings when the outer disc opening and the inner disc cut-out are rotated into alignment.

Further objects features. and advantages of the present invention will become apparent to those skilled in the art upon reviewing and comprehending the embodiment described below and as illustrated in the accompanying drawings.

BRIEF SUMMARY OF THE DRAWINGS

For the purpose of illustrating the invention, the drawings show a form which is presently preferred. However, the invention is not intended to be limited, nor is it limited, to the precise arrangement and instrumentalities shown.

DETAILED DESCRIPTION OF THE DRAWINGS

Figure 1:
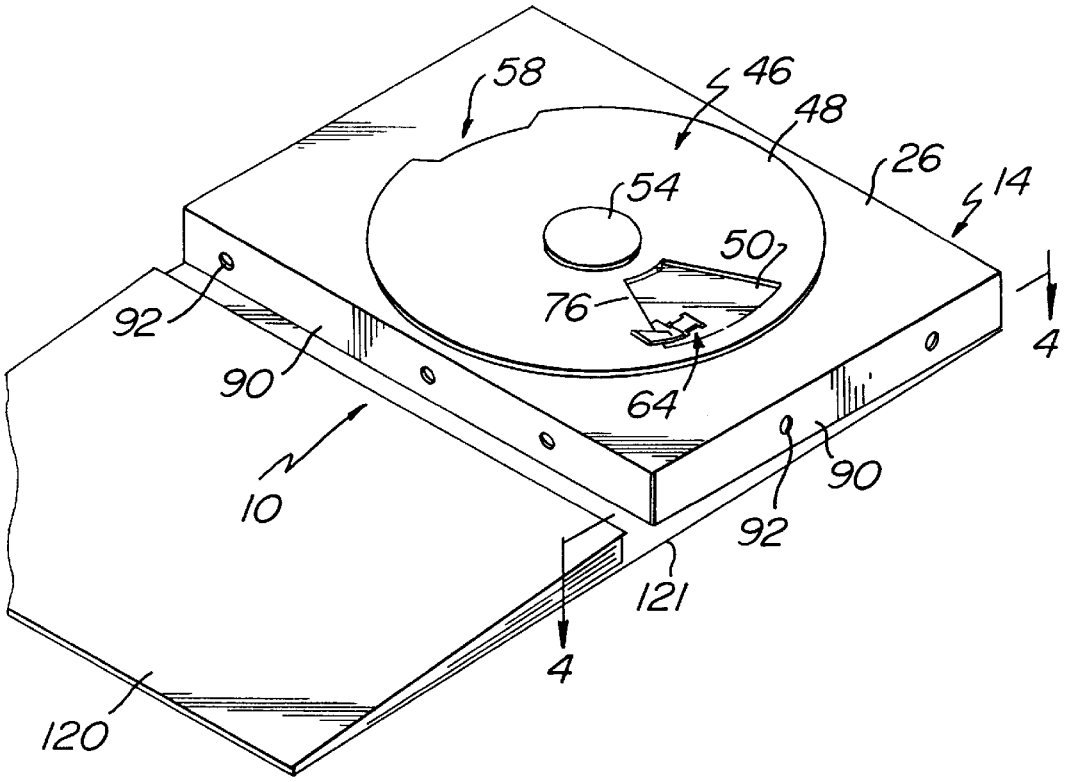
FIG. 1 is a perspective view of a interactive game as contemplated by the present invention.
Figure 5:
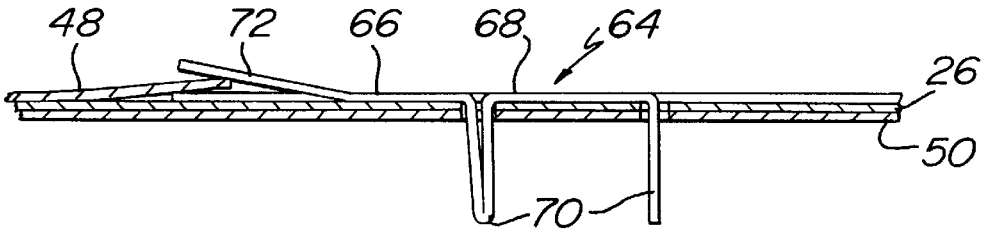
FIG. 5 shows a cross-sectional view of the game of the present invention as taken along line 5—5 in FIG. 2.

In the drawings where like numerals indicate like elements, there is shown an interactive game or puzzle having various portions which support a theme in accordance with the present invention. The game, as illustrated in FIGS. 1–6 is generally designated by the numeral 10.

Figure 2:
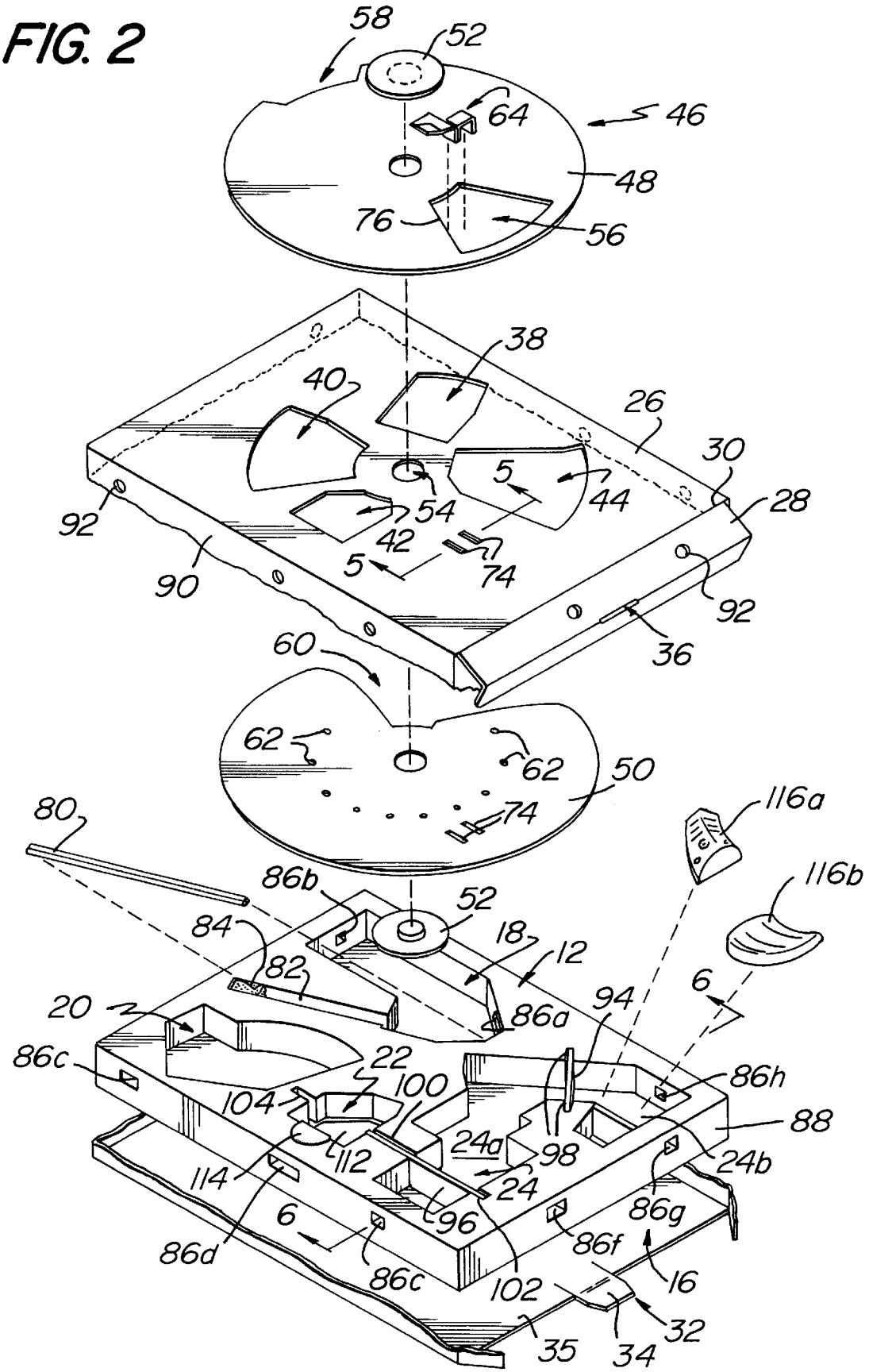
FIG. 2 is an exploded perspective view of the game of the present invention.

As shown in FIGS. 1 and 2, the game 10 includes a tray 12 having a generally rectangular cross-section and an outer container 14. The tray 12 is slidably engaged within the outer container 14. The tray is inserted into the outer container 14 through an opening 16 at one end of the outer container 14. The outer container 14 forms a close fitting sleeve for the tray 12.

The tray 12 includes a plurality of compartments 18. 20, 22, and 24 which are of the type adapted to receive and retain puzzle or treasure pieces, such as pieces 116*a* and 116*b* therein. The compartments are recessed in and open out to the top of the tray 12 such that the interior of each compartment is accessible from the top face 26 of the tray 12. The depth of each compartment is sufficient to accommodate the puzzle or treasure pieces such that they do not extend above the top surface 26 of the tray 12.

A flap portion 28 is provided at the open end 16 of the container 14. The flap portion 28 is hingedly attached at a fold line 30 to the top wall 26. A closure means 32 is provided on the bottom wall 34 of the container 12 to secure the flap portion 28 in the closed condition. The closure means 32 illustrated in FIG. 2 includes a lock tab 34 extending from the bottom wall 35 and a cooperating slot 36 in the flap portion 28 which is sized to accept the tab 34 therein. However, other forms of closure for containers are known and are contemplated for use with the present invention.

A plurality of openings 38, 40, 42, and 44 are formed in the top wall 26 of the container 14. Each opening is aligned with one of the compartments when the tray 12 is engaged within container 14. Each opening is sized and shaped similarly to the portion of the compartment which it overlies to facilitate access thereto.

A cover means 46 is provided on the top wall 26 of the outer container 14 to selectively conceal the contents of each compartment 18, 20, 22, and 24 which would otherwise be visible through the openings 38, 40, 42, and 44, respectively. The cover means illustrated in FIGS. 1 and 2 includes an outer or first disc 48 located outside the container 14 and an inner or second disc 50 located inside the container 14. The inner and outer discs 48 and 50 are rotatably mounted on a flanged post 52 which extends through a hole 54 formed in the top wall 26 of the container 14.

An aperture 56 is formed in the outer disc 48 which has a size and shape sufficient to expose the tray compartments to gain access to the contents therein. A notch 58 is formed at the edge of the outer disc 48 diametrically opposite the aperture 56. It is contemplated that indicia or descriptive matter (not shown) would be printed on the top surface 26 of the container 14 directly beneath and adjacent to the edge of the outer disc 48. This descriptive matter could be viewed through the notch 58 by rotating the outer disc.

A cut-out 60 is formed in the inner disc 50 which is also sized and to expose the tray compartments. A series of spaced holes 62 are also formed in a circular pattern around the inner disc approximately midway between the center and edge of the disc.

A lock means 64 is provided to prevent the discs 48 and 50 from rotating and to secure the discs in a storage position. In the storage position the discs conceal the tray compartments (as shown in FIG. 2). The lock means 64 illustrated in FIGS. 1, 2. and 5 includes a strip 66 which is folded into a U-shape base portion 68 with a pair of legs 70 extending transversely therefrom. The strip terminates in a split tab 72. A pair of parallel slots 74 are formed in the inner disc 50 and the top wall 26 of the container 14 for receiving the legs 70 of the lock means 64. However, other forms of locking are known and are contemplated for use with the present invention.

To lock the discs in the storage position, the inner disc 50) is rotated until its slots 74 are aligned with the slots in the top wall 26. The outer disc 48 is then rotated until the hole 54 overlies the slots 74. The legs 70 of the lock means 64 are inserted into the slots 74, securing the inner disc 50 in the storage position. An edge 76 of the hole 54 is then engaged by the split tab 72 to secure the outer disc 48 against rotation.

A pair of elongated sticks or rods 80 are provided for use with the interactive game 10 of the present invention. Preferably. the sticks 80 are stored in an elongated chamber 82 recessed in the tray 12 which opens onto one of the compartments. such as compartment 18. A biasing means 84, such as a wad of resilient material or a spring, is provided at the end of the chamber 82 to bias the sticks 80 against a side wall 81 of the compartment 18 (FIGS. 3 and 4).

Figure 3:
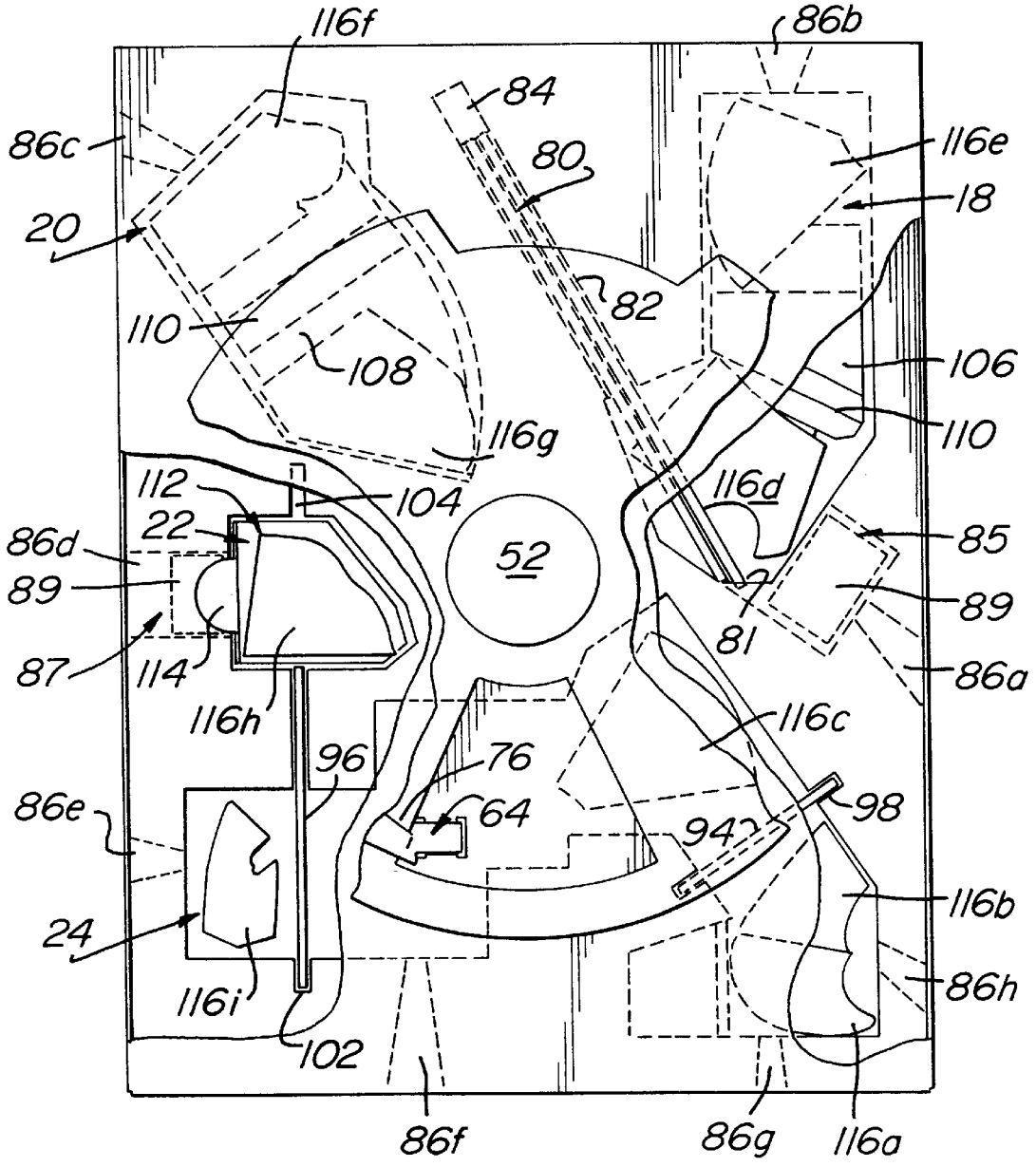
FIG. 3 is a partially cut-away plan view of the game of the present invention.
Figure 4:
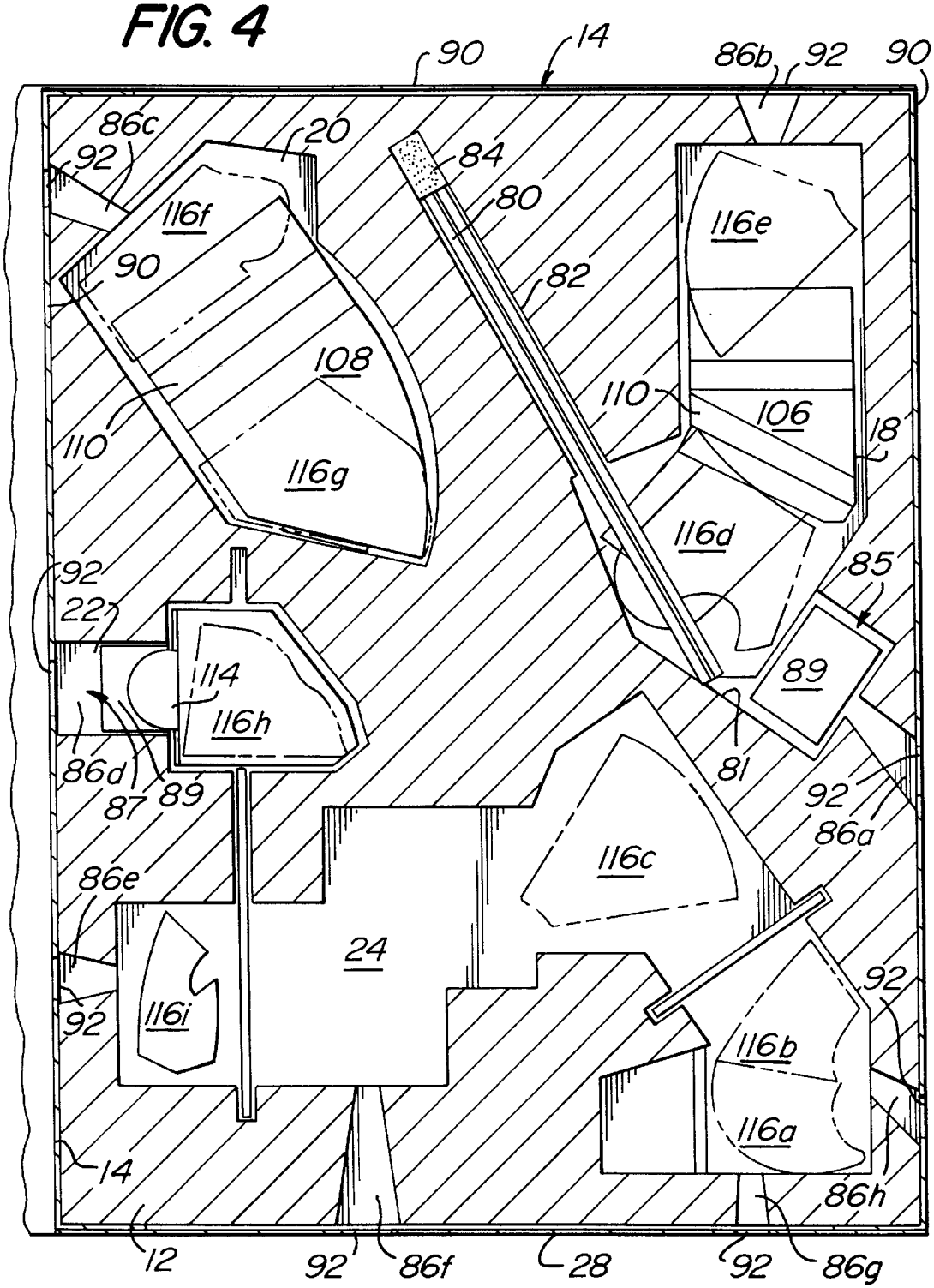
FIG. 4 shows a cross-sectional view of the game of the present invention as taken along line 4—4 in FIG. 1.

As shown in FIGS. 2, 3, and 4, the tray 12 includes a plurality of channels 86a–h which extend between the side walls 88 of the tray 12 and the interior of compartments 18, 20, 22, and 24. The channels are generally tapered inwardly to facilitate entry of a elongated probe, such as the sticks 80, from outside the tray. The sidewalls 90 of the outer container 14 are similarly provided with holes 92 which are aligned with the channels 86a–h and facilitate access thereto.

Channels 86*a* and 86*d* are provided with enlarged portions 85 and 87, respectively, which can serve as concealed storage areas for articles, such as folded notes 89. It is contemplated that indicia or other descriptive matter call be placed on the notes 89 to provide instructions or clues to the player.

Removable panels 94 and 96 arc located in compartment 24. The panel 92 extends across the compartment with its ends secured within a pair of notches 98 formed in opposed sidewalls of the compartment. The panel 94 separates the main portion 24*a* of the compartment from a distal portion 24*b*. The panel 92 is removed by lifting the panel out of the notches. When the panel 92 is removed, the distal portion 24*b* of compartment 24 is in communication with the main portion 24*a*.

A narrow channel 100 connects compartments 22 and 24. A pair of notches 102 and 104 are formed in opposed sidewalls of the compartments 22 and 24, respectively, and are in alignment with the channel 100. The panel 94 is slidably disposed within the channel 100 between a first position shown in FIG. 2 to a second position (not shown). In the first position, the panel 94 extends across the compartment 24 with one end in the notch 102 and separates a distal portion 24*c* of the compartment 24 from the main portion 24*a*. The panel 96 can be slidably moved until the other end of the panel is located within the notch 104. In this second position the distal end 24*c* of the compartment 24 is in communication with the main portion 24*c*.

As shown in FIG. 3 and 4, removable barriers 106 and 108 are disposed within compartments 18 and 20, respectively. The barriers are located on the floor of each compartment and are provided with upstanding folds 110 that serve as walls for dividing the compartments. It is contemplated that indicia or other descriptive matter can be placed on the barriers 106 and 108 to provide instructions or clues to the player.

Compartment 22 is similarly provided with a removable insert 112 located on the floor of the compartment. A tab 114 is formed on the insert 112 to facilitate grasping by a player. It is contemplated that indicia or other descriptive matter can be placed on the insert 112 to also provide instructions or clues to the player.

Figure 6:
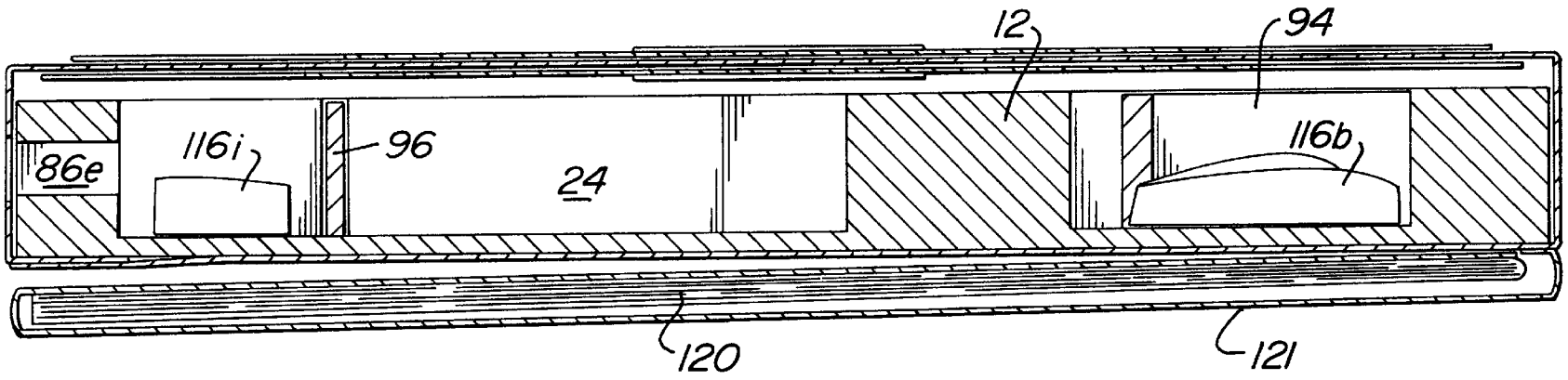
FIG. 6 shows a cross-sectional view of the game of the present invention as taken along line 6—6 in FIG. 2.

As illustrated in FIGS. 1, 2, and 6, various puzzle or treasure pieces 116*a–i* are located within the compartments 18, 20, 22, and 24. It is contemplated that the puzzle pieces 116*a–i* can be assembled in jig-saw puzzle-like fashion to form an assembled figurine or the like.

The game 10 operates in the following manner. Initially, the inner disc 50 is locked by the locking means 64 so that the cut-out 60 overlies opening 38 of the compartment 18. Following instructions printed on the outer container, an accompanying book, or the like, the player removes the locking means 64 releasing the inner and outer discs 48 and 50. The instructions direct the player to rotate the outer dial 50 until specified indicia, or the like, printed on the top face 26 of the container 14 is visible through notch 58. When this condition is met, the outer dial 50 is positioned so that the aperture 56 is also aligned with the opening 38, exposing the interior of the compartment 18. The player would now able to remove the sticks 80 and the first puzzle piece 116*d*. Fold 110 of barrier 106 conceals the remaining contents of the compartment 18 from the player's view.

At this point the player would be directed to insert one of the sticks 80 in channel 86*a*, displacing the folded note 89 from the enlarged portion 89 of the channel and into the exposed portion of the compartment 18 where it can be retrieved by the player. The instructions contained on the note 89 direct the player to rotate the inner disc 48 until a specified point is reached by using the sticks 80 in cooperation with the holes 62 spaced around the disc. When this position is reached the cut-out 60 would be aligned with the opening 44 of compartment 24*a*. The player would then be instructed to rotate the outer disc 50, as recited above, until the outer disc is also aligned with the opening 44, exposing the interior of the compartment 24*a*. The player would then be able to remove the second puzzle piece 116*c*.

Following the above procedures, the player would then be able to rotate the inner and outer discs 48 and 50 to expose the compartments 20 and 22 and retrieve the third and fourth puzzle pieces 116*h* and 116*g*. Following instructions an with the discs aligned with opening 40, the player can remove the barrier 108, allowing access to the remainder of the compartment 20 and providing additional instructions and clues. By inserting the stick 80 into channel 86*c*, the player could manipulate the fifth puzzle piece 116*f* until it can be retrieved through the opening 40. In a similar manner, barrier 106 can be removed and the sixth puzzle piece 116*e* retrieved by the player.

The remaining puzzle pieces 16*a*, 116*b*, and 116*i* can only be removed by removing the panels 94 and 96. To achieve this, the discs 48 and 50 are rotated until they overlie the opening 42 of the compartment 22. The player can now retrieve the removable insert 112 by grasping tab 114. The insert 112 can be provided with instructions for removing the panels 94 and 96.

Following these instructions the player would slide panel 96 until its end is within the notch 104. This places the panel 96 in the second position and places the distal portion 24*c* of compartment 24 in communication with the main portion 24*a*. The discs 48 and 50 are then rotated until they overlie opening 44 of compartment 24. By inserting the sticks 80 in channels 86*e* and 86*f*, the seventh puzzle piece 116*i* can be manipulated into position below opening 44 and retrieved therethrough.

In a similar manner, panel 96 can be lifted out of compartment 24. placing the distal portion 24*b* of compartment 24 in communication with the main portion 24*a*. By inserting the sticks 80 in channels 86*g* and 86*h*, the eighth and ninth puzzle pieces 116*a* and 116 can be manipulated into position below opening 44 and retrieved therethrough.

Finally, the discs 48 and 50 can be rotated back to compartment 22 and the sticks 80 inserted into channel 86*d* to push out the folded note 89 therein. This note 89 can provide instructions for the player to assemble the nine puzzle pieces 116*a–i* to form a complete figurine and solve the puzzle.

Of course, many alternate embodiments, themes, layouts, and arrangements of this idea are possible. The layout, shape, and number of compartments can be varied to accommodate any number, shape and/or size of puzzle piece. The layout of the compartments, channels, and/or openings can be altered to increase or decrease the difficulty of discovering all the puzzle pieces. Additional obstacles, such as additional panels and/or barriers, and additional clues, such as additional folded notes. Inserts and the like, can be provided to alter the difficulty of the game.

Many different themes are contemplated for the game 10, such as an Easter egg hunt, a haunted house, a treasure island, an archeological expedition, Chinese puzzles, grandma's house, and the like.

As illustrated in FIGS. 1 and 6. an accompanying book 120 may be provided for purposes of providing instructions or to further support the overall theme of the game and puzzle. The book 120 includes an extended back cover 121 attached to the bottom of the outer container 14. As seen in FIG. 6, the back cover 121 allows the book to fold inwardly within the cover for storage. however, other book forms are known and are contemplated for use with the present invention.

The game 10 of the present invention may also be modified by combining the outer container 14 and the tray 12 to form an integral structure. Alternatively, the top wall 26 of the container 14 may be attached to the top of the tray 12 without the need for the remainder of the container 14. Of course, other forms of covering the top of the tray 12 are known and contemplated for use with the present invention.

A number of variations for the cover means 32 are also contemplated. Instead of the rotating disc arrangement disclosed, many alternate arrangement would function equally as well. Individual doors for each compartment are contemplated as one alternate embodiment. A slidable lattice arrangement of strips which can be positioned to selectively cover the compartments is also contemplated.

The present invention may be embodied in other specific forms without departing from the spirit or essential attributes thereof and, accordingly, reference should be made to the appended claims, rather than to the foregoing specification, as indicating the scope of the invention.

I claim:

1. An interactive game comprising:

a tray;

a top wall which covers the tray, the tray having a plurality of recessed compartments adapted to receive and retain articles, at least one opening formed in the top wall and aligned with a portion of one of the compartments;

a cover for covering the at least one opening and concealing the interior of the one compartment;

at least one article located in the one compartment;

a channel formed in the tray which connects at least one of the compartments to the exterior of the tray; and a stick which is adapted to be inserted into the channel for manipulating an article within the compartment.

2.The interactive game as claimed in claim 1 wherein the channel comprises a plurality of channels formed in the tray, each channel connecting one of the compartments to the exterior of the tray.

3. The interactive game as claimed in claim 1 further comprising: an elongated chamber formed in the tray adapted to receive and hold the stick, the chamber being accessible through one of the compartments.

4. An interactive game comprising:

a tray;

a top wall which covers the tray, the tray having a plurality of recessed compartments adapted to receive and retain articles, at least one opening formed in the top wall and aligned with a portion of one of the compartments;

a cover for covering the at least one opening and concealing the interior of the one compartment;

at least one article located in the one compartment;

a removable panel located in one of the compartments for partitioning the compartment into a first and second portion, the first portion being in communication with the opening, the second portion being inaccessible to the opening until the panel is removed.

5. The interactive game as claimed in claim 2 further comprising: a removable panel located in one of the compartments for partitioning the compartment into a first and second portion, the first portion being in communication with the opening, the second portion being inaccessible to the opening until the panel is removed.

6. An interactive game comprising:

a tray;

a top wall which covers the tray, the tray having a plurality of recessed compartments adapted to receive and retain articles, at least one opening formed in the top wall and aligned with a portion of one of the compartments;

a cover for covering the at least one opening and concealing the interior of the one compartment, the cover comprising an inner disc and an outer disc, the inner disc having a cut-out portion, the outer disc having an opening, the discs being rotatably attached to the top wall, the discs adapted to cover the at least one opening when the outer disc opening and the inner disc cut-out are unaligned at least one article located in the one compartment.

7. The interactive game as claimed in claim 5, wherein the cover comprises an inner disc and an outer disc, the inner disc having a cut-out portion, the outer disc having an opening, the discs being rotatably attached to the top wall, the discs being adapted to cover the at least one opening when the outer disc opening and the inner disc cut-out are unaligned.

8. An interactive game comprising:

a tray;

a top wall which covers the tray, the tray having a plurality of recessed compartments adapted to receive and retain articles, at least one opening formed in the top wall and aligned with a portion of one of the compartments;

a cover for covering the at least one opening and concealing the interior of the one compartment;

at least one article located in the one compartment;

a removable folded barrier disposed in at least one of the compartments for blocking access to a distal portion of the compartment until the barrier is removed.

9. The interactive game as claimed in claim 1, wherein the top wall is defined by an outer container, the tray being engaged within the outer container, the at least one opening being formed in the outer container.

10. The interactive game as claimed in claim 2, wherein the top wall is defined by an outer container, the tray being engaged within the outer container, the at least one opening being formed in the outer container.

11. An interactive game comprising:

an outer container;

a tray engaged within the outer container, the tray including a plurality of compartments adapted to receive and retain articles, openings formed in the outer containers, each opening being aligned with at least a portion of one of the compartments;

a cover for selectively covering the openings and concealing the interior of the compartments;

articles located in the compartments; and channels formed in the tray which extend between the sidewalls of the tray and the interior of the compartments.

12. The interactive game as claimed in claim 11 comprising: a stick which is adapted to be inserted into the channels for manipulating the articles within the compartments.

13. The interactive game as claimed in claim 12 comprising: an elongated chamber formed in the tray adapted to receive and hold the stick, the chamber being accessible through one of the compartments.

14. The interactive game as claimed in claim 13 comprising: a removable panel located in one of the compartments for partitioning the compartment into a first and second portion, the first portion being in communication with one of the openings, the second portion being inaccessible to the one opening until the panel is removed.

15. The interactive game as claimed in claim 14, wherein the cover comprises an inner disc and an outer disc, the inner disc having a cut-out portion, the outer disc having an opening, the discs being rotatably attached to the outer container, the discs are dimensioned to cover the openings, the discs being adapted to selectively uncover the openings when the outer disc opening and the inner disc cut-out are aligned.

16. A method of playing an interactive game comprising the steps of:

providing a interactive game comprising an outer container, a tray engaged within the outer container and including a plurality of compartments adapted to receive and retain articles, openings formed in the outer container, each opening being aligned with at least a portion of one of the compartments, a cover for selectively covering the openings and concealing the interior of the compartments, articles located in the compartments, channels formed in the tray which extend between the sidewalls of the tray and the interior of the compartments;

manipulating the cover to selectively uncover the opening associated with one of the compartments to reveal an article;

inserting a stick within one of the channels associated with the one compartment, manipulating another article within the compartment until it is assessable through the opening; and manipulating the cover to selectively uncover another opening associated with another compartment to reveal another article.

17. A method of playing an interactive game as claimed in claim 16, wherein the stick inserting step comprises providing an elongated chamber formed in the tray adapted to receive and hold a stick, the chamber being accessible through the one compartment; removing the stick through the exposed opening; inserting a stick within one of the channels associated with the one compartment; and manipulating another article within the compartment until it is assessable through the opening.

18. A method of playing an interactive game as claimed in claim 16, further comprising the steps of:

providing a removable panel located in the one compartment for partitioning the compartment into a first and second portion, the first portion being in communication its associated opening; and removing the panel to bring the second portion in communication with the first portion.

19. A method of playing an interactive game as claimed in claim 16, wherein the cover provided in the interactive game providing step comprises an inner disc and an outer disc, the inner disc having a cut-out portion, the outer disc having an opening, the discs being rotatably attached to the outer container, the discs are dimensioned to cover the openings, the discs being adapted to selectively uncover the openings when the outer disc opening and the inner disc cut-out are aligned and wherein cover manipulating step comprises rotating the discs so that the outer disc opening and the inner disc cut-out are aligned to selectively uncover the opening associated with one of the compartments to reveal an article.

* * * * *